US005474091A

United States Patent [19]

Draghetti et al.

[11] Patent Number: 5,474,091

[45] Date of Patent: Dec. 12, 1995

[54] METHOD OF PRODUCING FILTER-TIPPED CIGARETTES

[75] Inventors: Fiorenzo Draghetti, Medicina; Salvatore Rizzoli, Bologna, both of Italy

[73] Assignee: G.D Societa' per Azioni, Bologna, Italy

[21] Appl. No.: 260,759

[22] Filed: Jun. 16, 1994

[30] Foreign Application Priority Data

Jun. 28, 1993 [IT] Italy ..... BO93A0298

[51] Int. Cl.[6] ..... A24C 5/47; A24C 5/52

[52] U.S. Cl. ..... 131/94

[58] Field of Search ..... 131/94

[56] References Cited

U.S. PATENT DOCUMENTS

| | | | |
|---|---|---|---|
| 3,091,245 | 5/1963 | Rudszinat et al. | 131/94 |
| 5,024,242 | 6/1991 | Garthaffner et al. | 131/94 |
| 5,033,482 | 7/1991 | Belvederi et al. | 131/94 |
| 5,135,008 | 8/1992 | Oesterling et al. | 131/94 |

FOREIGN PATENT DOCUMENTS

| | | | |
|---|---|---|---|
| 551307 | 11/1956 | Italy | 131/94 |
| 2241866 | 9/1991 | United Kingdom . | |

*Primary Examiner*—Jennifer Bahr

*Attorney, Agent, or Firm*—Marshall, O'Toole, Gerstein, Murray & Borun

[57] ABSTRACT

An orderly succession of first tobacco items, each including a double cigarette portion, is fed along a path along which the first items are cut into two cigarette portions which are separated by the insertion of a double filter to form a succession of second items, each including two cigarette portions separated by the double filter; each second item is rolled onto a respective strip connecting the two cigarette portions and the double filter to form a third item including a double cigarette; and the second items present, immediately upstream from the rolling station, a spacing approximately equal to but no less than the length of the respective strip.

5 Claims, 2 Drawing Sheets

METHOD OF PRODUCING FILTER-TIPPED CIGARETTES

BACKGROUND OF THE INVENTION

The present invention relates to a method of producing filter-tipped cigarettes.

As described, for example, in British Patent n. 2,241,866, filter-tipped cigarettes are produced on a filter assembly machine internally defining a path along which elongated tobacco items are fed in a direction perpendicular to their axis. The above known filter assembly machine is supplied at the input with a succession of first tobacco items consisting of double cigarette portions which, moving transversely along said path and through a cutting station, are each cut into two coaxial single portions. The portions in each coaxial pair are then parted axially and separated by the insertion of a double filter which, together with the respective two single portions, forms a second tobacco item hereinafter referred to as a "group". Inside a rolling station and by means of a gummed strip, the component elements of each second tobacco item are connected integral with one another to form a third tobacco item hereinafter referred to as a "double cigarette", and wherein the central portion of said strip encloses the double filter, and the end portions of the strip enclose the respective facing ends of the two cigarette portions.

To experts in the field, the rolling action to which the groups are subjected to form the double cigarettes is known to be a highly critical phase in that rolling over and above a given maximum speed, depending directly on the output capacity of the filter assembly machine, results in tobacco spill from the open ends of the two cigarette portions.

Also, for a given output capacity of the filter assembly machine, rolling speed is known to depend directly on the spacing with which the succession of groups is fed to the rolling station.

In connection with the above, it should be pointed out that, for convenience in terms of design and, more particularly, to conform with more widely used cigarette production lines, the standard spacing with which the groups are fed to the rolling station is relatively wide (roughly 37.7 mm). If, on the one hand, this facilitates a number of handling operations upstream from the rolling station, on the other it is directly responsible for large part of the rolling speed.

SUMMARY OF THE INVENTION

It is an object of the present invention to provide a method of producing filter-tipped cigarettes, designed to minimize the above drawback.

In particular, it is an object of the present invention to provide a method designed to minimize the rolling speed of the groups for a given output capacity of the filter assembly machine, or alternatively to maximize the output capacity of the filter assembly machine for a given rolling speed.

According to the present invention, there is provided a method of producing filter-tipped cigarettes, the method comprising stages consisting in feeding along a path an orderly succession of first tobacco items, each consisting of a double cigarette portion; cutting each first item, along said path, into a pair of cigarette portions; axially parting the cigarette portions in each said pair; separating the cigarette portions in each said pair by the insertion of a double filter to form a succession of second items, each consisting of two cigarette portions separated by the double filter; mating each second item with a respective strip of predetermined length; and, at a rolling station, winding said strip about part of the respective two cigarette portions and about the double filter to form a third item consisting of a double cigarette; characterized in that the second items are fed to the rolling station with a spacing approximately equal to but no less than the length of the respective strip.

In connection with the above method, it should be pointed out that currently produced cigarettes present a diameter ranging between 8.6 and roughly 5 mm; the respective strips present a length ranging roughly between 32 and 20 mm; and the statement "the second items are fed to the rolling station with a spacing approximately equal to but no less than the length of the respective strip." is intended to mean that the spacing with which the groups are fed to the rolling station is less than the standard spacing of 37.7 mm, and ranges between this and the length (32 to 20 mm) of the strip used.

Obviously, in the case of an all-purpose filter assembly machine, said spacing may be just over 32 mm, making a reduction in rolling speed of roughly 20% for a given output capacity, or a corresponding increase in output capacity for a given rolling speed. In the case of special-purpose machines, i.e. for producing cigarettes of one specific size, the spacing may be further reduced depending on the length of the strip used.

According to a preferred embodiment of the above method, the first items are fed along said path with a wider spacing in relation to that with which the second items are fed to the rolling station; a reduction in spacing being made along said path, upstream from the rolling station.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
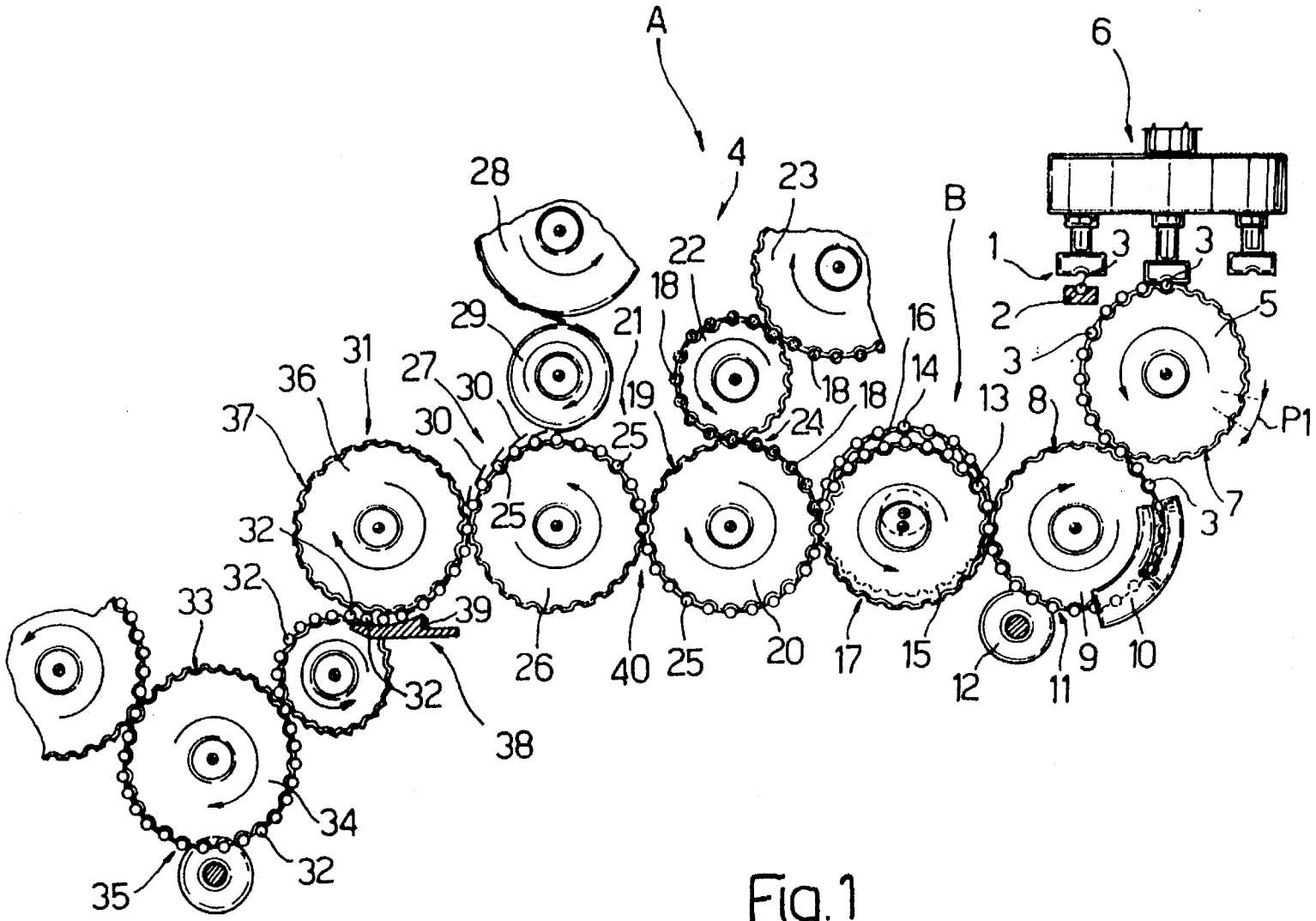
FIG. 1 shows a schematic view in perspective of a first portion of a system implementing the method according to the present invention.

In FIG. 1, A indicates a system for producing filter-tipped cigarettes and comprising a known cigarette manufacturing machine 1 in turn comprising an output plate 2 along which a continuous cigarette rod (not shown) is fed at substantially constant axial speed, and is cut by a known cutting head (not shown) into a succession of portions 3.

The cutting head (not shown) is rotated in known manner at such a speed as to form portions 3 of a length equal to the total length of the tobacco-filled portions of two filter-tipped cigarettes being produced.

Number 4 in FIG. 1 indicates a filter assembly machine, the input roller 5 of which is connected to output plate 2 of machine 1 by means of a rotary transfer unit 6, e.g. of the type described in U.S. Pat. No. 3,303,926 to which full reference is made herein in the interest of full disclosure. As it rotates about its axis, unit 6 transfers portions 3 successively and in known manner from output plate 2 into respective seats 7 equally spaced by spacing P1 about the periphery of input roller 5 which is powered to rotate anticlockwise (in FIG. 1) at constant angular speed about its axis parallel to plate 2.

As it rotates about its axis, roller 5 feeds portions 3, transversely in relation to their longitudinal axis, along an initial portion of a path B extending along the whole of machine 4; and transfers portions 3 successively to respective seats 8 equally spaced with said spacing P1 about the periphery of a roller 9 powered to rotate clockwise (in FIG. 1). Roller 9 is located tangent to roller 5, and provides for feeding portions 3 along a circular path forming part of path B and along which the ends of portions 3 are brought into contact with an aligning plate 10 for transversely aligning portions 3 perfectly with one another.

Once aligned, portions 3 are fed by roller 9, still along path B, through a cutting station 11 where a blade 12 cuts each portion 3 into two portions 13 and 14, which remain aligned in the same seat 8 and substantially contacting each other end to end.

Roller 9 is located tangent to the side by side rollers 15 and 16 of an axial parting or separating unit indicated as a whole by 17 and of the type described in U.S. Pat. No. 4,531,629 to which full reference is made herein in the interest of full disclosure. By virtue of unit 17, rollers 15 and 16 of which are offset vertically, portions 13 and 14 aligned inside each seat 8 are separated axially by a distance substantially equal to the length of a double filter 18, and are fed into seats 19 equally spaced with said spacing P1 about the periphery of a roller 20 substantially tangent to rollers 15 and 16, and rotating about its axis in the same direction as roller 9 and at the same surface speed as rollers 15 and 16.

Roller 20 is parallel to roller 9 and forms part of a known assembly unit 21 located along path B and also comprising a first and second roller 22 and 23 for supplying double filters 18. Roller 22 is located between and substantially tangent to rollers 20 and 23, rotates about its axis in the opposite direction to and at the same surface speed as rollers 20 and 23, and provides for feeding each double filter 18 into a respective seat 19 at a loading station 24 upstream from the point at which roller 20 is tangent to rollers 15 and 16. More specifically, roller 22 feeds each double filter 18 into a substantially central portion of respective seat 19, corresponding to the gap between the facing ends of a respective pair of cigarette portions 13 and 14, so that each double filter 18 defines, inside seat 19, two end gaps subsequently occupied by respective coaxial cigarette portions 13 and 14 to form, on roller 20, a group 25 consisting of two cigarette portions 13 and 14 separated by a double filter 18.

Groups 25 are fed successively by roller 20 to the input roller 26 of a finishing unit 27 also located along path B and comprising a first and second roller 28, 29 arranged cascade fashion and which provide for supplying roller 26 with a succession of strips 30, each for connecting cigarette portions 13 and 14 and double filter 18 into a respective group 25.

Figure 2:
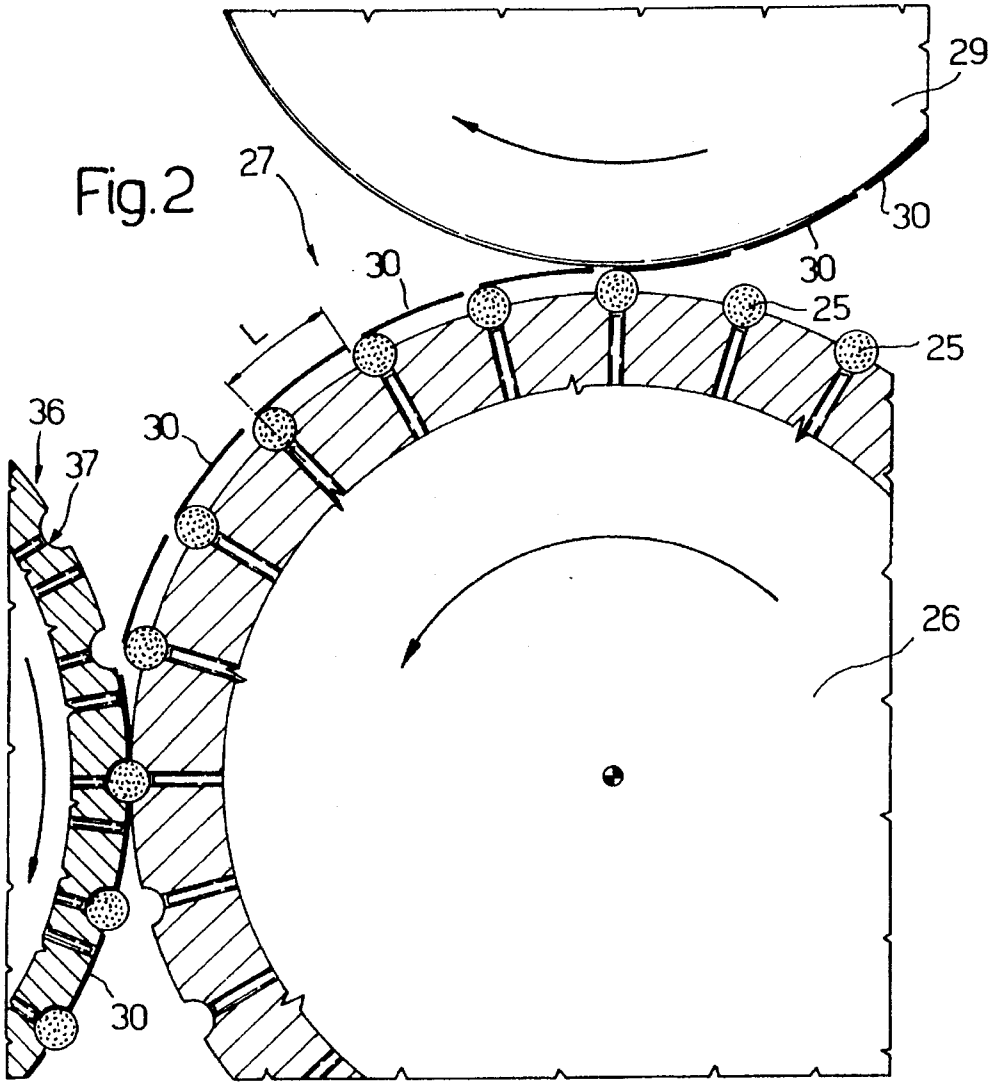
FIG. 2 shows a larger-scale view of a detail in FIG. 1.

As shown more clearly in FIG. 2, strips 30 present a length L approximately equal to but no less than the length of the circumference of cigarette portions 13 and 14, and approximately equal to but no more than spacing P1. More specifically, the value of spacing P1 will generally be just over 32 mm to ensure, between two adjacent groups 25, a gap just sufficient to enable each strip 30 to mate with and along an outer generating line of a respective group 25, and to extend from the respective group 25 towards but without contacting the adjacent group 25.

A P1 value of 32 mm provides for producing cigarettes of any currently produced size (maximum diameter roughly 8.6 mm), though smaller P1 values may obviously be employed in the case of special-purpose machines for producing special sizes.

Unit 27 also comprises a rolling unit 31 which provides for successively receiving groups 25 and strips 30; rolling each strip 30 about respective double filter 18 and the end portions of respective cigarette portions 13 and 14 facing the filter, to form a double cigarette 32; and feeding double cigarettes 32 into respective seats 33 on a roller 34 of a cutting unit 35 for cutting each double cigarette 32 in half to form two single cigarettes.

Rolling unit 31 comprises an input roller 36 with seats 37 equally spaced about the periphery of roller 36 with said spacing P1, and each receiving in known manner from roller 26 a respective group 25 and a respective strip 30. Roller 36 feeds groups 25 and respective strips 30 to a rolling station 38 defined by a fixed plate 39 facing the outer periphery of roller 36 and in turn defined in known manner, on the side facing roller 36, by a knurled cylindrical surface portion coaxial with roller 36 and separated from the outer cylindrical surface of roller 36 by a distance approximately equal to but no more than the diameter of a cigarette portion 13, 14.

From the foregoing description, therefore, spacing P1, at least theoretically, cannot be reduced to less than the length of the strips 30 employed, to prevent strip 30 from mating with two adjacent groups 25 on roller 26; whereas a reduction in spacing P1 reduces, for a given feed rate of groups 25 to station 38, the surface speed of roller 36 and hence rolling speed. More specifically, adopting, for example, a spacing P1 of 32 mm as opposed to the standard spacing of 37.7 mm, it is possible, for a given rolling speed, to increase the output capacity of machine 4 by roughly 20%.

Figure 3:
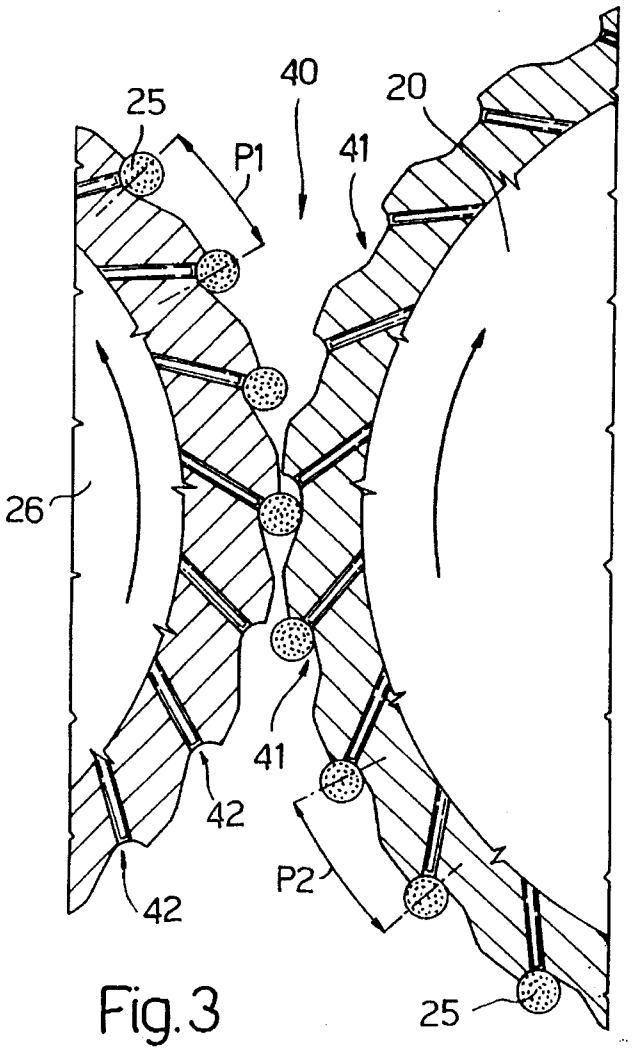
FIG. 3 shows a larger-scale view of a variation of a detail in FIG. 1.

In the FIG. 3 variation, the reduced spacing P1 is not adopted as of input roller 5 of machine 4, but only as of roller 26. Groups 25 in fact are advanced with a wider spacing P2, e.g. the standard spacing of 37.7 mm, along the initial portion of machine 4 as far as roller 20, and the spacing of groups 25 is reduced from P2 to P1 at a transfer station 40 at which groups 25 are transferred from roller 20 to roller 26. For this purpose, rollers 20 and 26 in the FIG. 3 variation present, in known manner, wider seats 41 and 42 to enable the spacing to be reduced.

We claim:

1. A method of producing filter-tipped cigarettes, the method comprising stages of feeding along a path (B) an orderly succession of first tobacco items (3), each comprising a double cigarette portion; cutting each first item (3), along said path (B), into a pair of cigarette portions (13, 14); axially parting the cigarette portions (13, 14) in each said pair; separating the cigarette portions (13, 14) in each said pair by the insertion of a double filter (18) to form a succession of second items (25), each consisting of two cigarette portions (13, 14) separated by the double filter (18); mating each second item (25) with a respective strip (30) of predetermined length L; at a rolling station (38), winding said strip (30) about part of the respective two cigarette portions (13, 14) and about the double filter (18) to form a third item (32) consisting of a double cigarette; and feeding the second items (25) to the rolling station (38) with a first spacing (P1) approximately equal to but no less than the length L of the respective strip (30); the first tobacco items (3) being fed along said path (B) with a second spacing (P2) wider than the first spacing (P1); and a spacing reduction being made along said path (B) upstream from the rolling station (38).

2. A method as claimed in claim 1, wherein said first spacing (P1) is less than 37 mm.

3. A method as claimed in claim 2, wherein said first spacing (P1) is close to 32 mm.

4. A method as claimed in claim 3, wherein said spacing reduction is made as said second items (25) are fed along said path (B).

5. A method as claimed in claim 1, wherein said spacing reduction is made as said second items (25) are fed along said path (B).

* * * * *